US008104852B2

(12) United States Patent
Oh et al.

(10) Patent No.: US 8,104,852 B2
(45) Date of Patent: Jan. 31, 2012

(54) REFRIGERATOR

(75) Inventors: Seung Hwan Oh, Gunpo-si (KR); Kyung Han Jeong, Seoul (KR); Sang Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 813 days.

(21) Appl. No.: 12/089,261

(22) PCT Filed: Oct. 5, 2005

(86) PCT No.: PCT/KR2005/003292

§ 371 (c)(1),
(2), (4) Date: Sep. 9, 2008

(87) PCT Pub. No.: WO2007/040290

PCT Pub. Date: Apr. 12, 2007

(65) Prior Publication Data

US 2009/0151380 A1 Jun. 18, 2009

(51) Int. Cl.
*A47B 88/00* (2006.01)

(52) U.S. Cl. ..... 312/402; 312/310

(58) Field of Classification Search ..... 312/402, 312/404, 330.1, 298, 312, 310, 302, 319.5–319.8, 312/410, 301; 62/382, 407
See application file for complete search history.

(56) References Cited

U.S. PATENT DOCUMENTS

| | | | | |
|---|---|---|---|---|
| 1,887,102 | A * | 11/1932 | Mathie | 312/303 |
| 2,564,336 | A * | 8/1951 | Lien | 312/9.43 |
| 2,769,676 | A * | 11/1956 | Larsen et al. | 312/306 |
| 3,246,939 | A * | 4/1966 | Petkwitz et al. | 312/274 |
| 3,613,566 | A * | 10/1971 | Shapleigh et al. | 100/218 |
| 5,429,043 | A * | 7/1995 | Becker | 99/448 |
| 7,527,343 | B2 * | 5/2009 | Oh et al. | 312/402 |
| 7,533,947 | B2 * | 5/2009 | Kim et al. | 312/402 |
| 7,581,796 | B2 * | 9/2009 | Jeong et al. | 312/402 |
| 7,600,829 | B2 * | 10/2009 | Oh et al. | 312/404 |
| 7,600,830 | B2 * | 10/2009 | Oh et al. | 312/404 |
| 7,600,831 | B2 * | 10/2009 | Oh et al. | 312/404 |
| 7,600,832 | B2 * | 10/2009 | Oh et al. | 312/404 |
| 7,600,833 | B2 * | 10/2009 | Oh et al. | 312/404 |
| 7,607,742 | B2 * | 10/2009 | Oh et al. | 312/402 |
| 7,625,052 | B2 * | 12/2009 | Kim et al. | 312/402 |
| 7,628,461 | B2 * | 12/2009 | Carden et al. | 312/402 |
| 7,669,944 | B2 * | 3/2010 | Oh et al. | 312/404 |
| 7,810,891 | B2 * | 10/2010 | Lee et al. | 312/402 |
| 2001/0054296 | A1 | 12/2001 | Kaiser | |

(Continued)

FOREIGN PATENT DOCUMENTS

| | | |
|---|---|---|
| EP | 1617159 | 1/2006 |

(Continued)

OTHER PUBLICATIONS

Korean Office Action issued in KR Application No. 10-2004-0073401 dated Jun. 26, 2006.

*Primary Examiner* — Janet M Wilkens

(74) *Attorney, Agent, or Firm* — KED & Associates, LLP

(57) ABSTRACT

Refrigerator for enabling putting in or taking out food to/from a basket (55) therein with of lowering a position of the user, such as bending oneself, and enabling the user to look into an inside of the basket (55) conveniently as the basket (55) is tilted in a lifted up state.

18 Claims, 5 Drawing Sheets

U.S. PATENT DOCUMENTS

| | | | | |
|---|---|---|---|---|
| 2005/0073225 | A1 | 4/2005 | Kwon | |
| 2006/0021373 | A1* | 2/2006 | Oh et al. | 62/407 |
| 2006/0022564 | A1* | 2/2006 | Oh et al. | 312/402 |
| 2006/0043848 | A1* | 3/2006 | Jeong et al. | 312/310 |
| 2006/0043849 | A1* | 3/2006 | Oh et al. | 312/310 |
| 2006/0196198 | A1* | 9/2006 | Kim et al. | 62/131 |
| 2009/0193836 | A1* | 8/2009 | Ertz et al. | 62/449 |

FOREIGN PATENT DOCUMENTS

| | | | |
|---|---|---|---|
| JP | 5296647 | * | 9/1993 |
| JP | 05-296647 | | 11/1993 |
| JP | 2004180885 | * | 7/2004 |
| KR | 1998-026267 | | 7/1998 |
| KR | 1999-0035524 | | 9/1999 |

* cited by examiner

[Fig. 3]
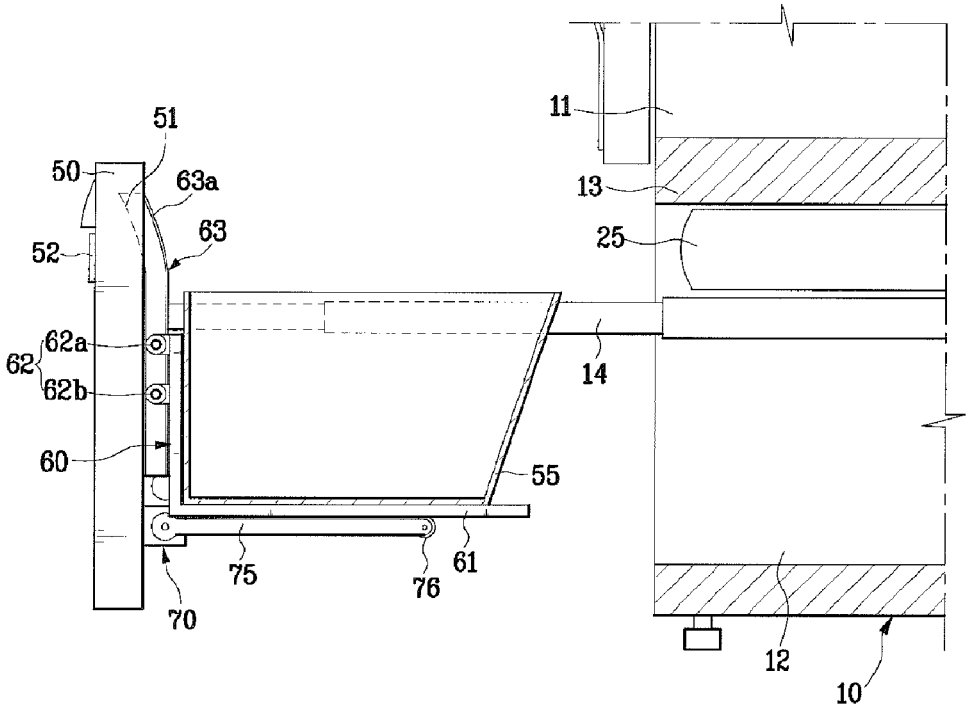
[Fig. 4]
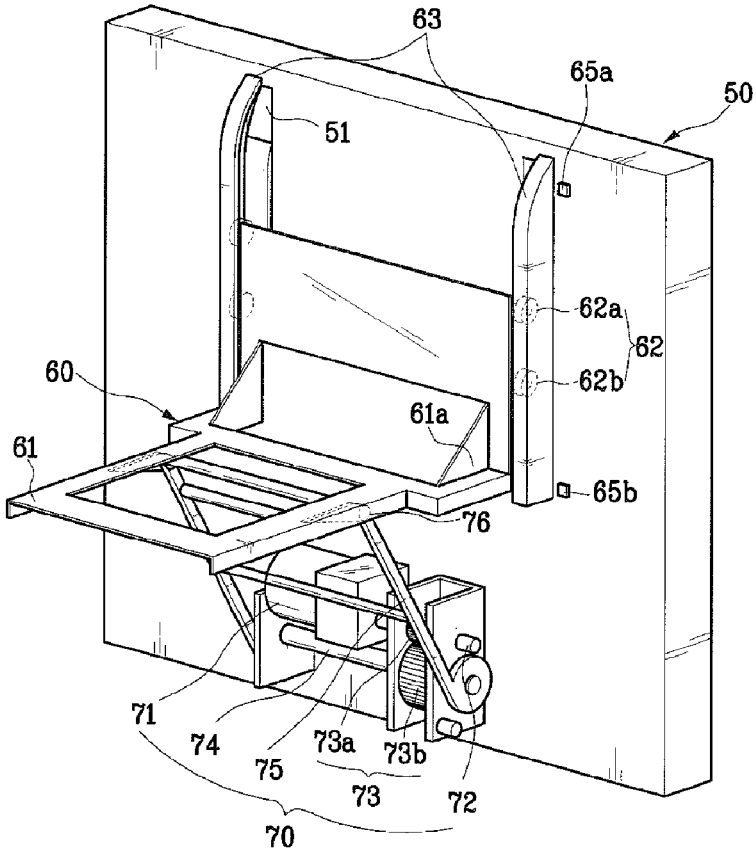

[Fig. 5]
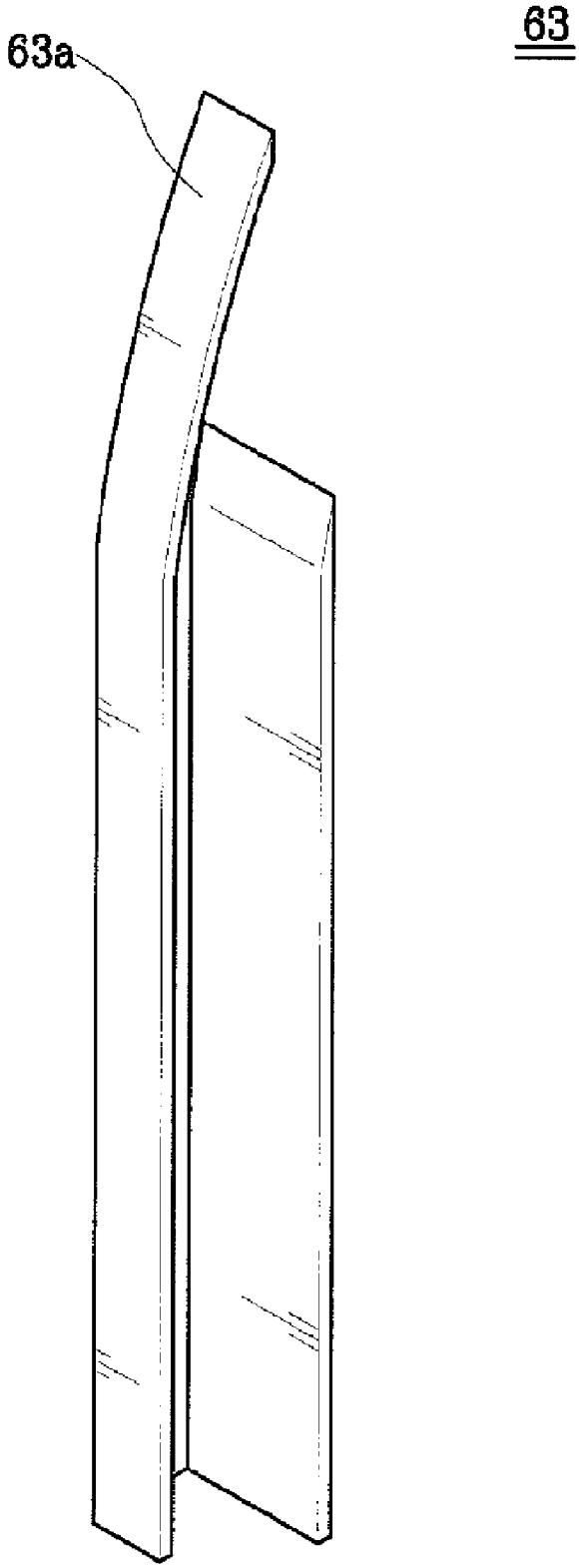

[Fig. 6]
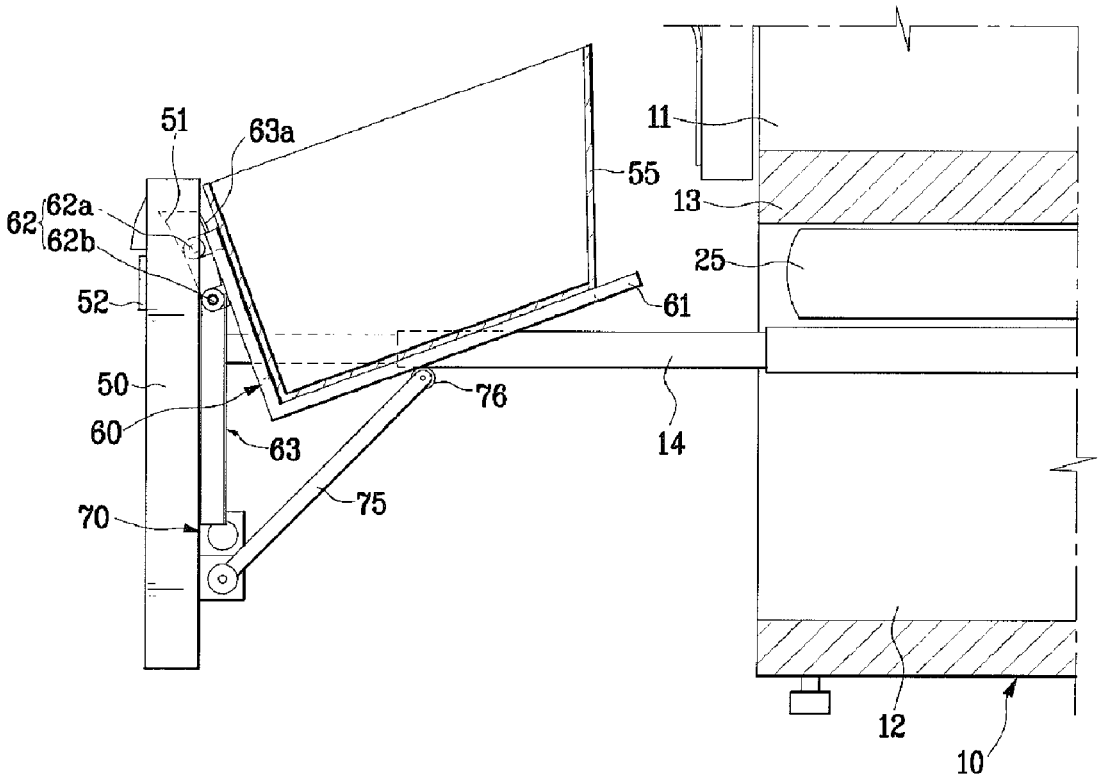

REFRIGERATOR

TECHNICAL FIELD

The present invention relates to a refrigerator from a basket of which food can be taken out conveniently.

BACKGROUND ART

In general, the refrigerator stores food at a low temperature. A related art refrigerator will be described with reference to FIG. 1.

The related art refrigerator is provided with a body 10 having storage chambers 11, and 12, and doors 21, and 22 for opening/closing the body. The body 10 is divided into upper/lower storage chambers 11, and 12 by a partition 13 (see FIG. 2). The upper/lower storage chambers 11, and 12 have upper/lower doors 21, and 22, respectively.

The upper doors 21 have hinges 21*a* at upper and lower ends for rotatably opening the upper doors 21 in left/right sides, respectively. The door 22 is slidably mounted in the body 10, for opening/closing the storage chamber 12 as the door 22 slides in a front/rear direction. That is, there are door rails 14 extendably mounted in front/rear direction on opposite sidewalls of the storage chamber for slidably supporting the door. Each of the door rails 14 has at least two rails each with a "⊂" section joined overlapped with the other, to form an extendable structure.

Inside of the storage chamber 12, there is a basket 24 with an opened top for putting food therein. The basket 22 can be drawn out of the storage chamber 12 together with the door 22. In general, vegetables or fruits are stored in the basket 24. Between the upper/lower storage chambers 11, and 12, there are drawers as shown in FIG. 2.

DISCLOSURE OF INVENTION

Technical Problem

However, the related art refrigerator has the following problems.

That is, when the basket is mounted at a lower portion of the body, since a position of the basket is low, the user is required to lower position by bending or squatting down for putting or taking out food. Particularly, because the user is required to find, and take out a kind of food from various kinds of food in a state the user bends, a time period of the user's bending becomes long, which is harmful to the health of the user.

Technical Solution

Accordingly, the present invention is directed to a refrigerator that substantially obviates one or more problems due to limitations and disadvantages of the related art.

An object of the present invention is to provide a refrigerator which enables a user to put, or take out food in/from a basket without lowering the user's position when the basket is mounted at a lower portion of a body thereof.

Another object of the present invention is to provide a refrigerator which has a basket of which inside can be seen well for taking out desired food therefrom, more conveniently.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body having a storage space therein, a door slidably mounted on the body for opening/closing the storage space in the body, a basket arranged in the storage space, a lift assembly fixedly secured to the door to enable to draw the basket, to enable to move up/down the basket when the door is opened, and to tilt the basket when the basket reaches to an upper side, and a driving unit for moving up/down the lift assembly.

Preferably, the lift assembly includes a lift for supporting the basket, and a guide member fixedly secured to the door for guiding the lift to move up/down, and having a portion sloped toward a front side of the body for tilting the lift when the lift reaches to the upper side.

Preferably, the guide member has an upper side sloped toward the front side of the body.

Preferably, the lift has substantially a "L" shape for supporting an underside and a front of the basket.

Preferably, the lift includes a sliding member for slidably coupling to the guide member. More preferably, the sliding member is arranged one sided on the upper side with respect to the middle of a height of the lift.

Preferably, the driving unit includes a driving motor, a gear unit fixed to a driving shaft of the driving motor, a driven shaft fixed to the gear unit, and a driving arm fixed to the driven shaft for moving up/down the lift.

In another aspect of the present invention, a refrigerator includes a body having a storage space therein, a door slidably mounted on the body for opening/closing the storage space in the body, a basket arranged in the storage space, a lift assembly including a lift for supporting a front side and an underside of the basket, a guide member fixedly secured to the door for guiding the lift to move up/down, having a portion sloped toward a front side of the body for tilting the lift when the lift reaches to the upper side, and a sliding member arranged one sided on the upper side with respect to the middle of a height of the lift, and movably coupled to the guide member, and a driving unit for moving up/down the lift assembly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings;

FIG. 3 illustrates a side view of a refrigerator in accordance with a preferred embodiment of the present invention;

FIG. 4 illustrates a perspective view showing a lift assembly, and a driving unit of the refrigerator in FIG. 3;

FIG. 5 illustrates a perspective view showing a guide member mounted on a door of the refrigerator in FIG. 3; and FIG. 6 illustrates a side view showing a lifted state of the basket in the refrigerator in FIG. 3.

BEST MODE FOR CARRYING OUT THE INVENTION

Figure 1:
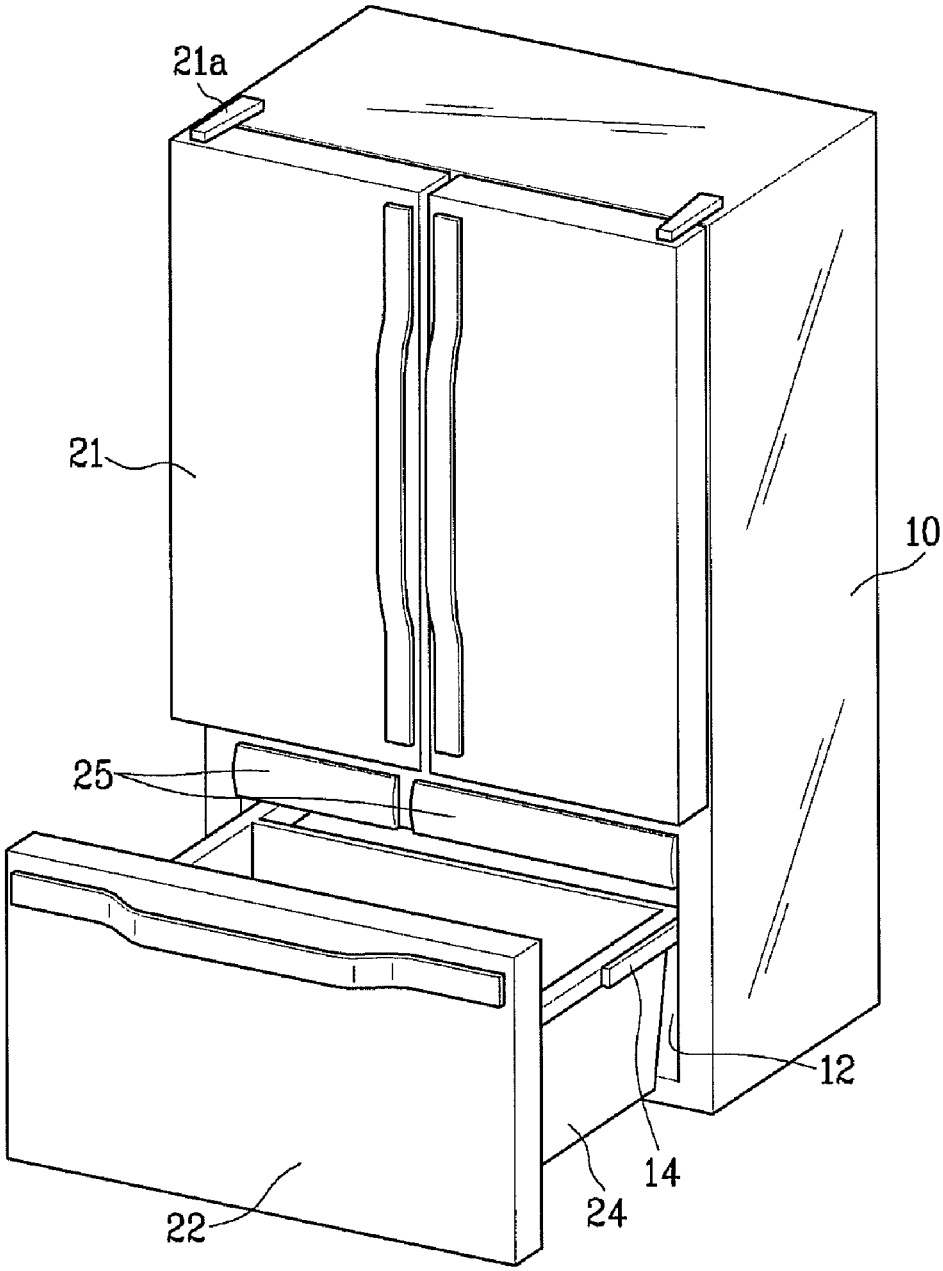
FIG. 1 Prior Art
FIG. 1 illustrates a perspective view of a related art refrigerator.
Figure 2:
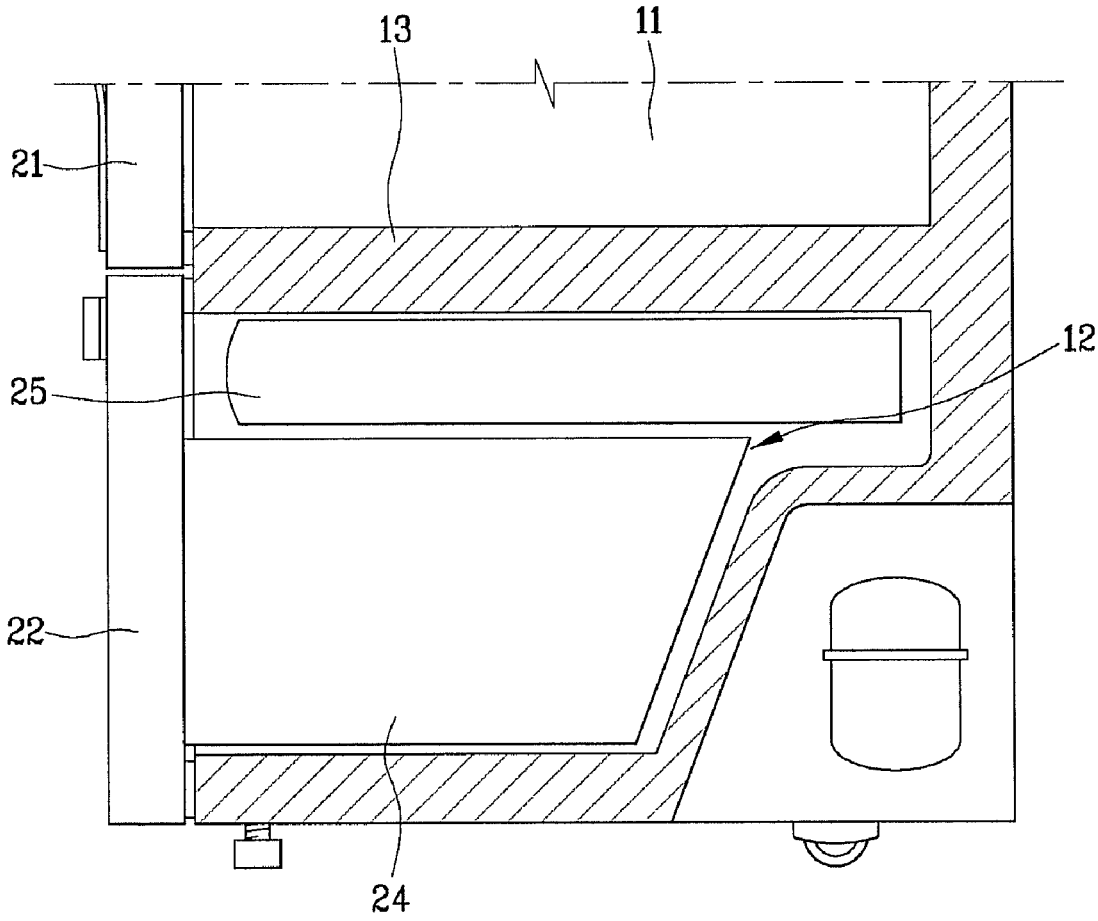
FIG. 2 Prior Art
FIG. 2 illustrates a side view of the refrigerator in FIG. 1.

Reference will now be made in detail to the preferred embodiments of the present invention, examples of which are illustrated in the accompanying drawings. Wherever possible, the same reference numbers will be used throughout the drawings to refer to the same or like parts.

A refrigerator in accordance with a preferred embodiment of the present invention will be described with reference to FIG. 3.

Referring to FIG. 3, the refrigerator includes a body 10 having storage chambers 11, and 12, a door 50 slidably mounted on the body for opening/closing the storage chamber 12 in the body 12, a basket 55 in the storage chamber 12, a lift assembly 60 mounted to the door 50 for drawing out the basket 55, moving the basket 55 up/down in a door open state, and tilting the basket 55 when the basket reaches to an upper side of the door, and a driving unit 70 for moving up/down the lift assembly.

The present invention is applicable to a refrigerator having one storage chamber, or two or more than two storage chambers arranged in an up/down direction as far as the basket arranged at a lower position is movable in up/down direction. In this instance, the basket may be mounted to a bottom storage chamber or a storage chamber on the bottom storage chamber as far as the basket is at the lower position. FIG. 3 illustrates an example in which the basket is mounted to the bottom storage chamber of the body having two or more than two storage chambers.

It is preferable that there is an control unit 52 on a front of the door 50 for moving up/down the lift assembly 60 by means of the driving unit 70. It is preferable that the control unit 52 has a button (not shown) for selecting moving up/down of the lift assembly 60. The driving unit 70 may be designed to move up if a predetermined time period is passed after the door 50 is opened. In this case, the control unit 52 is required to have a moving down button 52 only.

Moreover, on opposite sidewalls of the storage chamber 12, there are two or more than two door rails 14 overlapped on the other each extendable when the door 50 is opening/closing. For an example, by slidably joining door rails each having substantially a "⊂" section between the door 50 and the body 10, the door rails can be fabricated extendable. There may be a variety of door rail structures as far as the door rail is extendable when the door is opened/closed.

An embodiment of the lift assembly and the driving unit will be described with reference to FIG. 4.

The lift assembly 60 includes a lift 61 for supporting the basket 55, and a guide member 63 fixedly secured to the door 50 for guiding moving up/down of the lift 61, having a portion sloped toward a front side of the body 10 for tilting the lift 61 when the lift 61 reaches to an upper side of the door.

It is preferable that the lift has a sliding member 62 for slidably mounting the lift to the guide member. There may be a variety of sliding member structures, including rollers.

It is preferable that the lift 61 has substantially a "L" shape for supporting an underside and a front of the basket 55 for secure supporting of the underside of the basket 55 on which a load of the basket 55 acts, and of the front on which the load of the basket 55 acts when the basket 55 tilts. Of course, it is apparent that the lift 61 may be designed to support opposite sides, front and rear, or a top of the basket 55. There may be a variety of shapes of the lift 61 as far as the lift 61 can move up/down the basket 55.

Moreover, the lift 61 has a fall off preventing rib 61*a* for holding an underside of the basket 55.

Referring to FIGS. 4 and 5, it is preferable that the guide member 63 has one surface of a rear side sloped to forward by a predetermined angle θ. The slope at an upper side of the guide member tilts an upper side moving path of the sliding member to a front side of the body 10. It is preferable that a portion of the door has a slot 51 of a pre-determined size for inserting the sliding member 62.

It is preferable that the guide member 63 is mounted on a rear surface of the door symmetrically, for balanced action of the weight balance of the basket 55 on the lift 61. For an example, if an odd number of the guide members 63 are arranged vertically, it is preferable that one is arranged in the middle of the door 50, and the other two are arranged on opposite side symmetry with respect to the guide member at the middle. As shown in FIG. 5, it is preferable that the guide member is arranged on opposite sides symmetrically with respect to the middle of the door 50 if an even number of the guide members are to be arranged, vertically.

The sliding members 62 are inserted in the guide members 63, respectively. As shown in FIG. 4, the guide members 63 have facing opened surfaces, or, though not shown, opposite opened surfaces. Of course, it is apparent that a surface of the guide member 63 on a body 10 side of the refrigerator may be opened. Besides above structure, there may be a variety of structures of the guide member.

The sliding member 62 is secured to one surface of the lift 61 on a door side thereof opposite to the guide member 63. As an example, it is preferable that two or more than two rows of the sliding members 62 are secured o the lift 61 opposite to the guide members 63. Or, only one sliding member 62 may be secured opposite to every guide member 63.

It is preferable that the sliding member 62 is arranged one sided on an upper side of the lift 61 with respect to a middle of height of the lift 61. This is for the sliding member to make stable supporting of the basket and the lift assembly at the time the lift 61 is lifted up and tilted to a front side when weights of the basket 55 and the lift assembly 60 act on a body 10 side.

The door 50 has a top sensor 65*a* for sensing reach of the lift 61 to an uppermost position, and a bottom sensor 65*b* for sensing reach of the lift 61 to a lowest position. The top sensor 65*a* and the bottom sensor 65*b* are position sensors. It is preferable that the top, and bottom sensors 65*a*, and 65*b* are connected to a control unit (not shown), and the control unit is connected to the driving unit 70, electrically.

The driving unit 70 includes a driving motor 71, a gear unit 73 fixed to a driving shaft 72 of the driving motor 71, a driven shaft 74 fixed to the gear unit 73, and a driving arm 75 having one end fixed to the driven shaft 74 and the other end arranged to push up the lift 61.

It is preferable that the driving motor 71 is reversible for moving up/down the basket 55.

The gear unit 73 includes a driving gear 73*a* fixed to the driving shaft 72 of the driving motor 71, and a driven gear 73*b* engaged with the driving gear 73*a* and fixed to the driven shaft 74. There are the driving arms 75 on opposite ends of the driven shaft 74. Since the driving arms 75, fixed to the same shaft, have the same rotation speed, enabling to make balanced lift up of the lift 61.

It is preferable that the gear unit 73 has an appropriate gear ratio, taking a rotation speed of the driving arm 75 into account. The gear ratio of the gear unit 73 is required to be designed such that the driving arm 75 has a torque enough to push up the lift 61. It is preferable that there is a roller 76 mounted to the other end of the driving arm 75 for sliding along an underside of the lift 61.

In the meantime, though not shown, as the driving unit, there may be the following variation.

As the driving unit, a rack and pinion structure may be used. The driving unit moves up/down together with the basket. In this instance, the rack is fixedly secured to the door vertically, and the pinion is coupled to a motor with a shaft, to move up/down along the rack. When the motor rotates, the pinion moves up/down along the rack, to make the basket to move up/down. In this instance, it is required that the motor is mounted to be movable with the lift assembly.

Moreover, it is apparent that a ball screw system can be employed as the driving unit. The ball screw is secured to the door vertically, for moving up/down the basket as the ball screw rotates. In this structure, the driving motor only rotates the ball screw, but is fixed such that the driving motor does not move up/down.

The operation of the foregoing preferred embodiment of the present invention will be described.

When the user pulls the door 50 forward, the door rails 14 are extended as the door 50 slides. In this instance, as the door rails 14 have a predetermined number of stages of rails mounted overlapped with the other, the door rails 14 extend as the door 50 is opened.

After opening the door fully, a button is selected from the control unit 52 for putting the driving unit 70 into operation.

Following rotation of the driving motor 71, both the driving gear 73*a* and the driven gear 73*b* rotate, and as the driven shaft 74 fixed to the driven gear 73*b* rotates, the driving arm 75 rotates. In this instance, since the driving arms 75 are fixed at opposite sides of the driven shaft 74, the other ends of the driving arm 75 apply the same force to opposite sides of the lift 61, to push up the lift 61. At the same time with this, the sliding member 62 rotates on, and moves upward along the guide member 63.

Referring to FIG. 6, when the lift 61 reaches to the upper side of the guide member 63, the sliding member 62 is positioned at a sloped surface of the guide member 63. Therefore, following tilting of the lift 61, the basket 55 is tilted. In this instance, weights of the lift 61 and the basket 55 act on the sliding member 62 and the guiding member 63. According to this, the sliding member 62 applies a reaction force toward a front side of the body 10, and a lower side sliding member 62 applies a reaction force toward a rear side of the body 10.

As the basket 55 moves up thus, the user can take out desired food from the basket 55 in a standing position. Moreover, as the basket 55 is tilted, the user can see an inside of the basket 55, permitting to identify desired food, more quickly.

When the user selects the button 52 after the user takes out the food thus, the driving motor 71 rotates in a direction opposite to the time the basket 55 moves up. According to this, when the lift 61 and the basket 55 move down to a lower portion, the user pushes the door 50 into the storage chamber 12. In this instance, the door 50 is closed following overlap of the door rails 14.

INDUSTRIAL APPLICABILITY

As has been described, the refrigerator of the present invention has the following advantages.

First, since the basket at a lower portion of the body is mounted movable in an up/down direction, the user can put in, or take out food without lowering position, such as bending oneself.

Second, since the basket is tilted in a moved up state, the user can look into an inside of the basket conveniently. According to this, the user can find out food more comfortably, and more quickly.

Third, the quicker taking out of food from the basket permits to shorten a door open time period, to reduce loss of cold air, together with reduction of power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A refrigerator, comprising:

a body having a storage space therein;

a door slidably mounted on the body to open and close the storage space;

a basket mounted on the door and which slides into and out of the storage space with the door; and a lift assembly mounted on the door, wherein the lift assembly moves the basket upward and downward with respect to the door and causes the basket to tilt as it is lifted.

2. The refrigerator of claim 1, wherein the lift assembly comprises:

a guide unit mounted on the door, wherein the guide unit guides upward and downward movement of the basket;

a sliding unit mounted on the guide unit, wherein the sliding unit moves along the guide unit as the basket is moved upward and downward;

a lift unit that is attached to the sliding unit and that supports the basket; and a driving unit that causes the lift unit to move upward and downward with respect to the door.

3. The refrigerator of claim 2, wherein an upper portion of the guide unit is sloped such that the basket will tilt as it moves upward with respect to the door.

4. The refrigerator of claim 2, wherein the lift unit supports a bottom and a front side of the basket.

5. The refrigerator of claim 2, wherein the lift unit includes at least one rib that prevents the basket from falling off the lift unit as the basket is moved.

6. The refrigerator of claim 2, wherein a portion of the sliding unit that engages the guide unit is located above the lift unit.

7. The refrigerator of claim 2, wherein the guide unit comprises two guide rails located on opposite side of the door.

8. The refrigerator of claim 7, wherein the sliding unit comprises two sliding members, wherein each sliding member is mounted on a corresponding one of the guide rails.

9. The refrigerator of claim 8, wherein slots are formed on the door adjacent the upper portions of the guide rails, and wherein the sliding members pass into the slots as the basket is moved upward with respect to the door.

10. The refrigerator of claim 8, wherein each sliding member comprises two rollers that move along one of the guide rails.

11. The refrigerator of claim 1, wherein the lift assembly includes a lift unit and a driving unit which causes the lift unit to move the basket upward and downward, and wherein the driving unit comprises:

a driving motor mounted on the door and having a driving shaft;

a driving gear fixed to the driving shaft;

a driven gear mounted on a driven shaft, wherein the driven gear is engaged with the driving gear; and at least one driven arm mounted on the driven shaft, wherein rotation of the driven shaft causes the at least one driven arm to move the lift unit upward and downward relative to the door.

12. The refrigerator of claim 11, wherein a roller is mounted at an end of the at least one driven arm such that the roller contacts an underside of the lift unit.

13. A refrigerator, comprising:

a body having a storage space therein;

a door slidably mounted on the body to open and close the storage space;

a basket mounted on the door and which slides into and out of the storage space with the door; and a lift assembly mounted on the door, wherein the lift assembly moves the basket upward and downward with respect to the door, the lift assembly comprising:

a guide unit mounted on the door, wherein the guide unit guides upward and downward movement of the basket, and wherein the guide unit causes the basket to tilt as it moves upward, a sliding unit mounted on the guide unit, wherein the sliding unit moves along the guide unit as the basket is moved upward and downward, a lift unit that is attached to the sliding unit and that supports the basket, and a driving unit that causes the lift unit to move upward and downward with respect to the door.

14. The refrigerator of claim 13, wherein the guide unit comprises at least one guide rail that guides movement of the sliding unit, and wherein an upper portion of the at least one guide rail is curved to cause the basket to tilt.

15. The refrigerator of claim 13, wherein the lift unit supports a bottom and a front side of the basket such that the basket can be stably supported as it lifts and tilts.

16. The refrigerator of claim 13, wherein the driving unit comprises:

at least one arm that is rotatably mounted on the door, wherein an upper end of the at least one arm supports a bottom of the lift unit; and a driving motor mounted on the door and coupled to the at least one arm such that the at least one arm rotates when the motor is operated.

17. The refrigerator of claim 13, further comprising:

a top sensor that detects when the basket has moved to the top of is moving path; and a bottom sensor that detects when the basket has moved to the bottom of its moving path.

18. The refrigerator of claim 13, wherein when the door is slid out from the storage space, the driving unit automatically causes the basket to be moved upward with respect to the door, and further comprising a control unit which a user can operate to cause the driving unit to move the basket downward with respect to the door.

* * * * *